United States Patent [19]

Webster

[11] 4,339,989

[45] Jul. 20, 1982

[54] HYDRAULIC RAMS

[76] Inventor: Raymond G. Webster, 10 Ravenswood Dr., Chorley New Road, Heaton, Bolton, Lancashire, England

[21] Appl. No.: 100,748

[22] Filed: Dec. 6, 1979

[30] Foreign Application Priority Data

Dec. 18, 1978 [GB] United Kingdom ..... 48916/78

[51] Int. Cl.[3] ..... F01B 7/20

[52] U.S. Cl. ..... 92/53; 92/128

[58] Field of Search ..... 92/51, 52, 53, 128

[56] References Cited

U.S. PATENT DOCUMENTS

| | | | |
|---|---|---|---|
| 1,928,533 | 9/1933 | Goss | 92/53 |
| 2,438,285 | 3/1948 | Houldsworth | 92/51 |
| 2,517,153 | 8/1950 | Wood . | |
| 2,783,744 | 3/1957 | Tennis | 92/52 |
| 3,007,449 | 11/1961 | Fuehrer | 92/51 |
| 3,119,455 | 1/1964 | Fuehrer | 92/52 |
| 3,136,221 | 6/1964 | Walker | 92/53 |
| 3,172,339 | 3/1965 | Quayle | 92/51 |
| 3,298,463 | 1/1967 | McIntosh | 92/52 |
| 3,483,798 | 12/1969 | Parrett | 92/52 |
| 3,722,375 | 3/1973 | Sievenpiper | 92/53 |
| 3,934,423 | 1/1976 | Haller | 92/52 |
| 3,939,758 | 2/1976 | Faisandier | 92/94 |

FOREIGN PATENT DOCUMENTS

| | | |
|---|---|---|
| 1208573 | 1/1966 | Fed. Rep. of Germany . |
| 2044644 | 2/1971 | France . |
| 2259297 | 8/1974 | France . |
| 2259229 | 8/1975 | France . |
| 2290613 | 6/1976 | France . |
| 2301714 | 9/1976 | France . |
| 2362297 | 3/1978 | France . |
| 250173 | 6/1926 | United Kingdom . |
| 1019262 | 2/1966 | United Kingdom . |
| 1120127 | 7/1968 | United Kingdom . |
| 1437071 | 5/1976 | United Kingdom ..... 92/52 |

*Primary Examiner*—Abraham Hershkovitz

[57] ABSTRACT

A multi-stage hydraulic ram is provided with telescopic ram tubes which are terminated by end assemblies which provide a working surface for hydraulic fluid under pressure and a sliding bearing on a next adjacent ram tube. Each of the end assemblies is so mounted on its associated tube and so dimensioned that removal of it from the tube and the ram in an axial direction can be carried out without obstruction from the end assembly of the next adjacent ram of smaller diameter.

10 Claims, 4 Drawing Figures

HYDRAULIC RAMS

Figure 1:
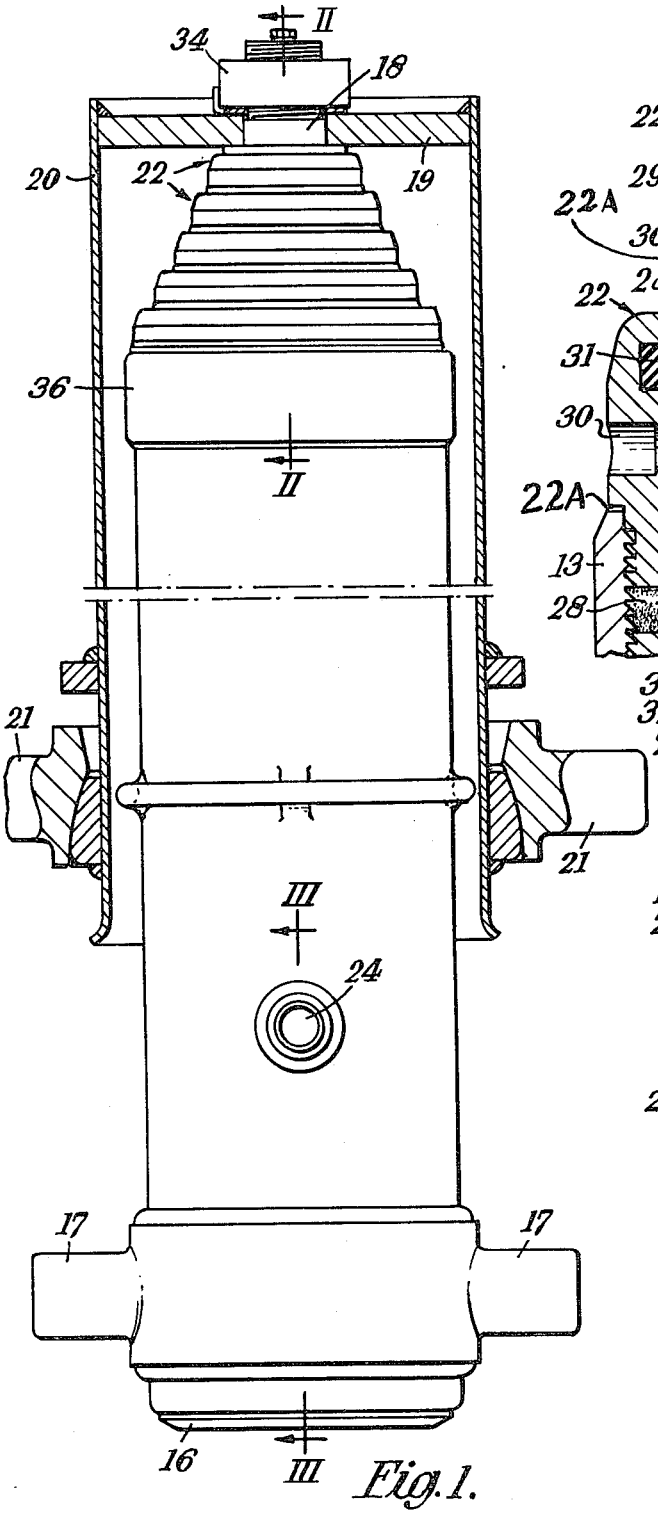

The present invention relates to hydraulic rams and particularly to multi-stage hydraulic rams comprising a plurality of telescopic ram tubes extendible by a hydraulic fluid under pressure.

In a multi-stage hydraulic ram hitherto proposed the ends of the ram tubes are provided with end assemblies which embrace the ends of the tubes and thus provide an obstruction on the exterior surfaces of the ram tubes. This is a disadvantage when it becomes necessary to remove an end assembly for inspection or for subsequent removal of a ram tube other than that of smallest diameter because removal of the end assembly cannot be effected without removing the end assembly of the ram tube of smallest diameter and the end assemblies of any other intervening ram tubes.

It is an object of the present invention to provide a multi-stage hydraulic ram which does not suffer from this disadvantage.

According to the present invention there is provided a multi-stage hydraulic ram comprising a plurality of telescopic ram tubes extendible by a hydraulic fluid under pressure, each of at least a first of the ram tubes and a second of the ram tubes next adjacent to and of smaller diameter than the first of the ram tubes including an end assembly mounted on the end of the tube to provide a working surface for the hydraulic fluid and to provide a sliding bearing on a next adjacent ram tube, the end assembly of the second of the ram tubes so engaging the second of the ram tubes and being so dimensioned that the end assembly of the first of the tubes can be disengaged from the first of the tubes and withdrawn in an axial direction without removal of the end assembly of the second of the ram tubes.

In a preferred embodiment of the invention each end assembly comprises an annular member having an exterior surface with a screw threaded portion in screw threaded engagement with a screw threaded portion of an interior surface of the associated ram tube and an interior surface providing a bearing for the next adjacent ram tube of smaller diameter. With this arrangement each end assembly may serve as an abutment for a stop on the next adjacent tube of smaller diameter to prevent ejection of the tube of smaller diameter from the next adjacent tube of larger diameter, the arrangement being such that the removal of the end assembly of the next adjacent tube of larger diameter allows withdrawal of the next adjacent tube of smaller diameter.

Preferably, the screw threaded portion of the exterior surface of the annular member is provided on a shank portion of an annular nut having an annular head portion located axially beyond the end of the associated ram tube and being of greater diameter than the shank portion, but of smaller diameter than the outside diameter of the associated ram tube, the end of the associated ram tube abutting against a shoulder between the head portion of the nut and the shank portion of the nut.

In a preferred embodiment of the invention each end assembly further comprises a sleeve having an exterior surface with a screw threaded portion in screw threaded engagement with a screw threaded portion of the interior surface of the associated ram tube, the sleeve being located at a position axially spaced inwardly from the end of the associated ram tube and providing the working surface for the hydraulic fluid and a sliding bearing for the next adjacent ram tube of smaller diameter. The sleeve may be axially spaced from the end of the shank portion of the nut to provide an annular axially extending space therebetween and one or more annular seals may be located in the space to provide a hydraulic fluid seal between the ram tube with which the nut and sleeve are associated and the next adjacent ram tube of smaller diameter.

In the preferred embodiment of the invention, the ram tube of smallest diameter is fitted with an end plug extending axially from and closing the end of the ram tube, the end plug being adapted to receive an end plate secured thereto by a nut screwed on to the end plug, and the end plate carrying a cylindrical outer cover extending over the ram tubes and being provided with trunnions for connection of the ram to a load.

Figure 4:
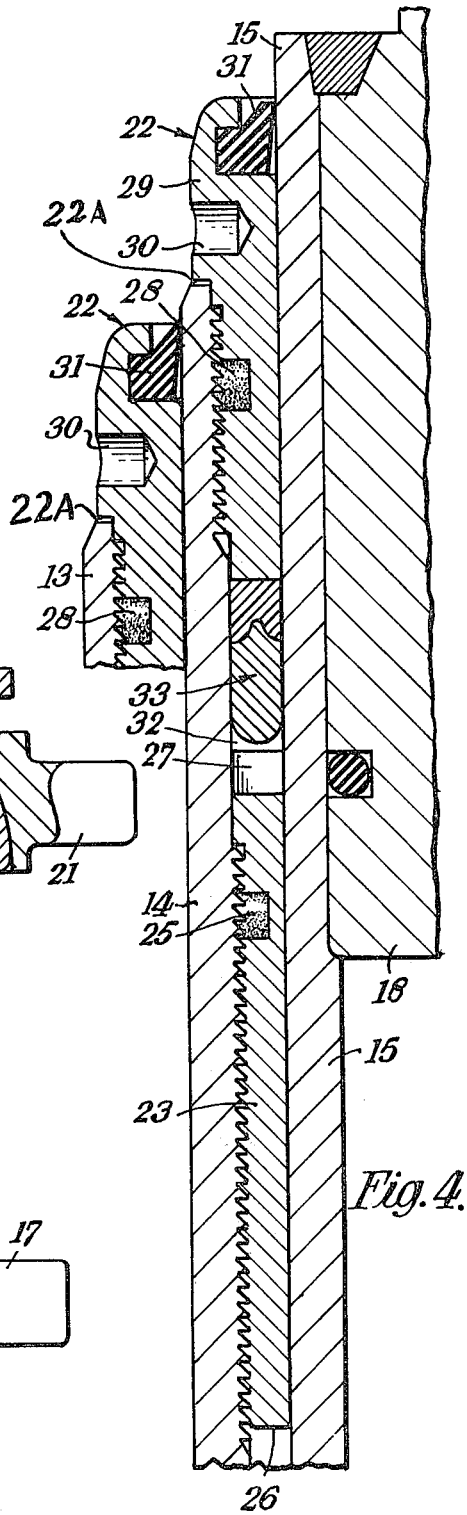
Figure 2:
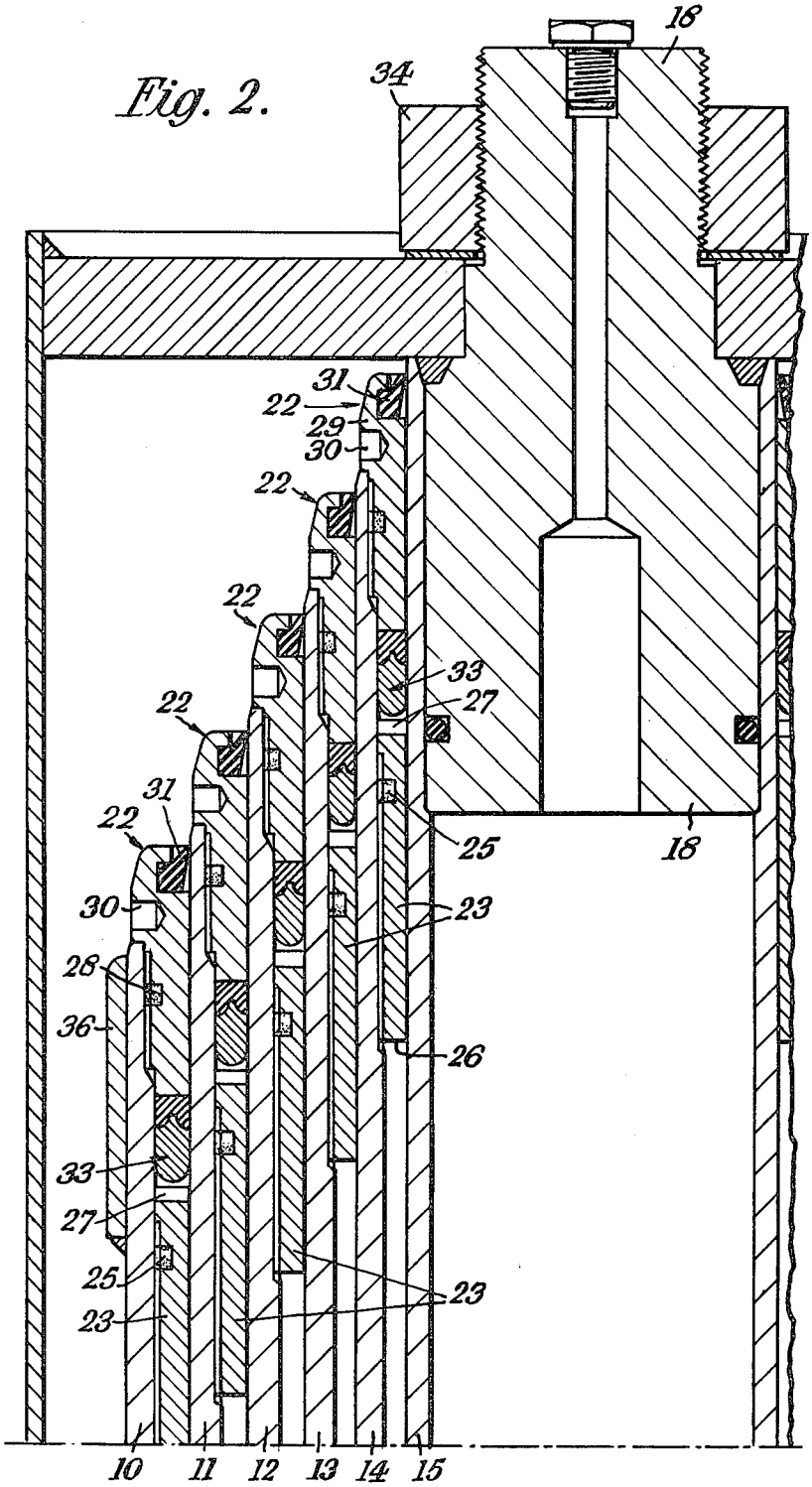
Figure 3:
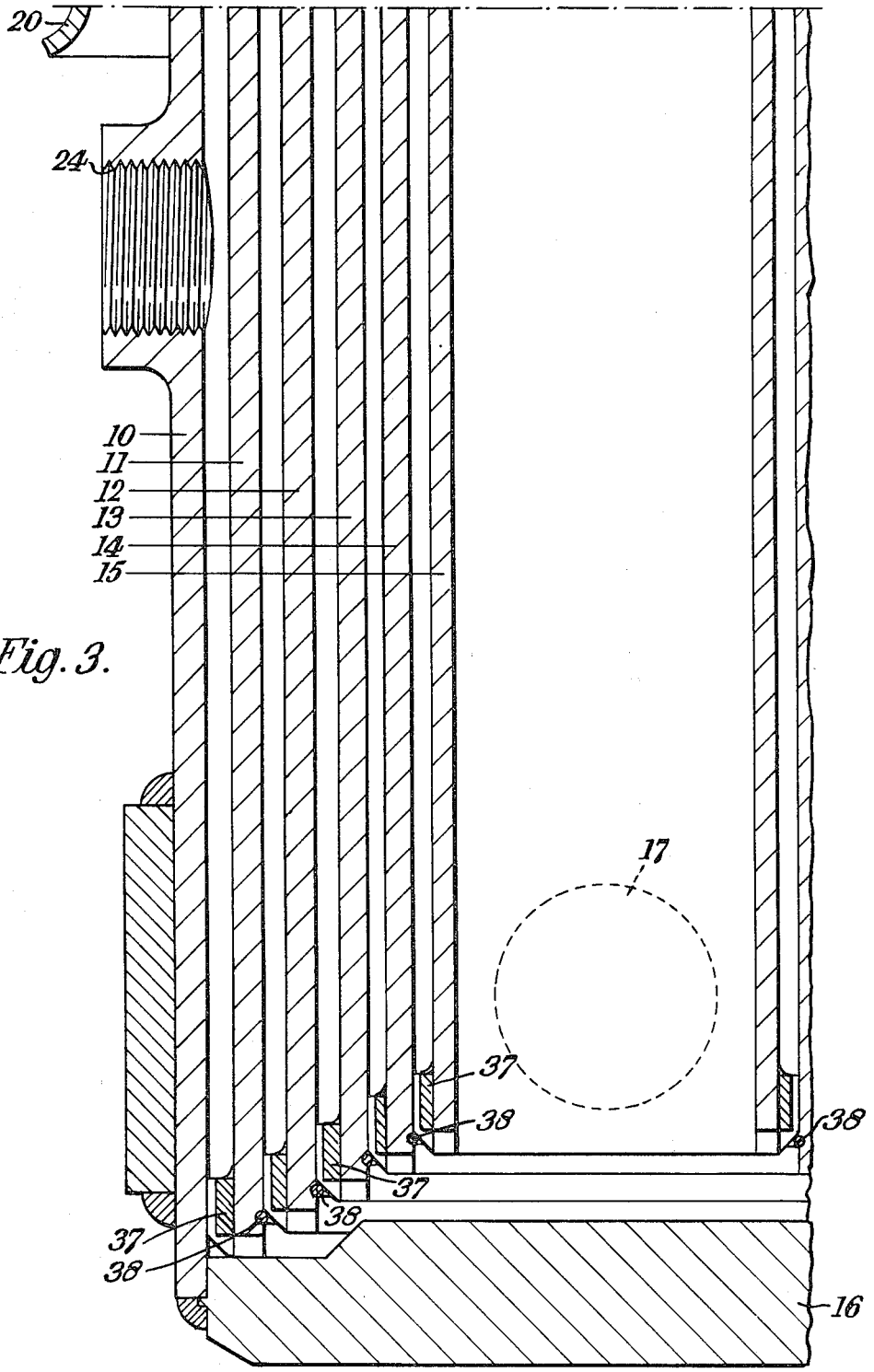

One embodiment of the invention will now be described by way of example with reference to the accompanying drawings in which:

FIG. 1 is a side elevation of a multi-stage hydraulic ram according to the invention, FIG. 2 is a section of part of the ram shown in FIG. 1, taken on the line II—II in FIG. 1, FIG. 3 is a section of a further part of the ram shown in FIG. 1, taken on the line III—III in FIG. 1, and FIG. 4 is a section of part of the ram shown in FIG. 2, drawn to an enlarged scale.

The ram illustrated in the drawings comprises six telescopic ram tubes 10,11,12,13,14,15, the ram tube 10 of largest diameter having a trailing end closed by a base cap 16 and carrying, on said end, trunnions 17. An inlet 24 for hydraulic fluid under pressure is provided in the ram tube 10. The ram tube 15 of smallest diameter has a leading end closed by an end plug 18 to which is connected an annular end plate 19 by a single nut 34. An outer cover 20 depends from the end plate 19 and carries towards its open end trunnions 21 for connection of the ram to a load.

The ram tube 15 of smallest diameter is welded to the end plug 18 but each of the remaining tubes 10,11,12,13,14, is provided with an end assembly comprising a nut 22 and a sleeve 23. Only one such end assembly will be described, that associated with the second smallest diameter ram tube 14, it being understood that the remaining end assemblies are similarly constructed and arranged with respect to their associated ram tubes.

The sleeve 23 has a buttress-threaded exterior surface which is in screw-threaded engagement with a buttress-threaded portion of the interior surface of the ram tube 14 and which is axially spaced inwardly from the end of the ram tube 14. A nylon pellet 25 is provided between the threads to lock the screw-threaded engagement. A radially extending wall 26 of the sleeve 23 provides a working surface for hydraulic fluid under pressure and the buttress threads ensure that the force so generated is transmitted to the ram tube 14 in an axial direction only to prevent radially outward forces on the ram tube 14 which tend to splay the end of the ram tube 14. The inner surface of the sleeve 23 provides a sliding bearing on the next adjacent ram tube 15 of smaller diameter. A ring key slot or slots 27 are provided for screwing the sleeve 23 into and out of the ram tube 14.

The nut 22 comprises a buttress-threaded shank portion which is in screw-threaded engagement with a buttress-threaded portion of the interior surface of the ram tube 14 adjacent to the end of the ram tube 14. A nylon pellet 28 is provided between the threads to lock the screw-threaded engagement. The interior surface of the nut 22 provides a sliding bearing surface on the next adjacent ram tube 15 of smaller diameter. The nut 22 includes a head portion 29 axially beyond the end of the ram tube 14 and of greater diameter than the shank portion. The end of the ram tube 14 abuts a shoulder between the head portion 29 and the shank portion. The diameter of the head portion 29 is less than the outside diameter of the ram tube 14 so that an axial extension of the exterior surface of the ram tube 14 is unobstructed for a purpose to be described below. The head portion 29 includes a key ring hole or holes 30 for screwing the nut 22 into and out of the ram tube 14. The outer end of the head portion 29 carries a wiper seal 31 which engages with the exterior surface of the next adjacent ram tube 15 of smaller diameter.

An annular axially extending gap 32 formed between the end of the nut 22 and the end of the sleeve 23 contains a composite seal 33 which provides a hydraulic fluid tight seal between the end assembly and the ram tube 15. The seal 33 comprises two rings, one of the rings being of rubber/fabric material and the other ring being injection moulded in a material sold by E. I. Du Pont under the trade name HYTREL. The positioning of the seal 33 between the ends of the end assembly allows the seal 33 to remain in the closest possible contact with the exterior of the ram tube 15 even if, due to wear, the axis of the ram tube 15 and the axis of the end assembly are no longer co-axial but at a small angle to one another. An additional ring of rubber/fabric material or HYIREL (trade name) may, in an alternative arrangement, be located between the two rings referred to above.

A shim or shims 22A may be provided between the end of the ram tube 14 and the shoulder of the head portion 29. Removal of one or more shims allows the nut 22 to be screwed further into the ram tube 14 to decrease the axial length of the gap 32 and compress the composite seal 33 in the gap 32 to compensate for wear of the seal.

The ram 10 of greatest diameter is provided with an annular support collar 36 around the exterior surface of its leading end to resist radially outward forces on said end applied in us by the hydraulic fluid under pressure.

The trailing ends of the five smaller ram tubes 11,12,13,14,15 are each provided with a fluted slider ring 37 extending around the outer surface to maintain the trailing ends of the ram tubes in spaced relationship. The interior surface of each of the four ram tubes 11,12,13,14 between the ram tubes 10,15 of greatest and smallest diameter carries a support ring 38 which engages the slider ring 37 of the next adjacent ram tube of smaller diameter to limit collapsing movement of the ram tubes.

In use, hydraulic fluid under pressure is fed through the inlet 24 and acts initially on the radial surface of the end plug 18 and on the support rings 38, but subsequently acts on the working surfaces 26 of the sleeves 23 to extend the ram tubes. Axial extension of the ram tubes is limited by engagement between the slider rings 37 and the sleeves 23.

A major advantage of the ram described above with reference to the drawings is the ease of removal of an end assembly for inspection and replacement of the seal or for removal of a ram tube for replacement of the ram tube or of the seal or sleeve 23. Removal is achieved by removing the end plate 19 with the outer cover 20. The nut 22 of the ram tube next adjacent to and of larger diameter than that of the seal 33 and sleeve 23 to be removed is then unscrewed by use of a key ring in holes 30 and removed. The seal 33 and sleeve 23 to be removed can then be withdrawn. This is possible because the end assembly of the next adjacent ram tube of smaller diameter leaves an axial extension of the end of the exterior surface of the tube unobstructed. Reinsertion of a replacement sleeve 23 and seal 33 is similarly easily achieved.

A further advantage of the ram described above with reference to the drawing occurs should a sliding ring 37 fail and the associated ram tube be forced out by the hydraulic fluid under pressure. Due to the position of the composite seal 33, once the end of the ejected ram tube has passed this seal, an annular gap will exist between the exterior surface of the ejected ram tube and the interior surface of the nut 22 of the next adjacent tube of greater diameter which will provide a vent for the hydraulic fluid under pressure, thus lessening the ejection velocity of the ejected tube.

I claim:

1. A multi-stage hydraulic ram, comprising:

a plurality of telescopic ram tubes extendable by a hydraulic fluid under pressure;

end formation means provided between each of said ram tubes and disposed at the exposed ends of said ram tubes for providing a working surface for the hydraulic fluid, each of said end formation means having a sliding surface on one longitudinal surface thereof for enabling a sliding movement of an adjacent ram tube of next higher diameter relative to an adjacent ram tube of next smaller diameter, each of said end formation means further including:

a removable end assembly means located at the exposed ends of said ram tubes, and located annularly between each of said ram tubes, said end assembly means including an annular member having an exterior surface, said exterior surface including a screw threaded portion in screw threaded engagement with a screw threaded portion of an interior surface of the associated ram tube, said annular member having an interior surface providing said sliding surface for the next adjacent ram tube of smaller diameter, spacer means disposed annularly between each of said ram tubes, said spacer means providing said working surface for the hydraulic fluid, and removable annular sealing means located longitudinally between the removable end assembly means and the spacer means and located annularly between each of the ram tubes for providing a hydraulic fluid tight seal between the end assembly means and the spacer means along said sliding surface thereof, each of the end assembly means being dimensioned to enable one of the end assembly means and the sealing means associated therewith to be withdrawn in an axial direction without the need to remove the next adjacent end assembly means associated with the ram tube of the next smaller diameter.

2. A ram according to claim 1, wherein the exterior surface of each end formation means includes a stop means for providing an abutment for the next adjacent ram tube of smaller diameter to prevent the ejection of the tube of smaller diameter from the next adjacent tube of larger diameter, the removal of the end formation of the next adjacent tube of larger diameter allows withdrawal of the next adjacent tube of smaller diameter.

3. A ram according to claim 2, wherein the annular member includes a shank portion of an annular nut, each of the end assembly means including an annular head portion axially beyond the end of the associated ram tube, integral with said shank portion, and being of greater diameter than the shank portion forming a shoulder, the end of the associated ram tube abutting said shoulder between the head portion of the nut and the shank portion of the nut.

4. A ram according to claim 3, wherein the outside diameter of the annular head portion of the nut is of smaller diameter than the outside diameter of the associated ram tube.

5. A ram according to claim 4, wherein each of the end assembly means includes an annular seal in contact with the exterior surface of the next adjacent ram tube of smaller diameter to provide a hydraulic fluid tight seal between the end assembly means and the said exterior surface.

6. A ram according to claim 3 wherein said spacer means includes an exterior surface having a screw threaded portion, the exterior surface of said spacer means being in screw threaded engagement with a screw threaded portion of the interior surface of the associated ram tube.

7. A ram according to claim 6, wherein the spacer means is axially spaced from the end of the annular sealing means.

8. A ram according to claim 7, further comprising shim means positioned at said shoulder between the head portion of the annular nut and the end of the associated ram tube, removal of said shim means following wear of the ram in use allowing the end assembly means to be screwed further into the associated ram tube to decrease the axial length between said end assembly means and said spacer means to compensate for wear of the sealing means.

9. A ram according to claim 6 wherein the screw threaded shank portion of the end assembly means and the screw threaded portion of the spacer means are formed with buttress threads, and the screw threaded portion of the shank and the spacer means further including inserts of a synthetic material for holding the end assembly means and the spacer means in the positions to which they have been screwed.

10. A ram according to claim 9, wherein the annular sealing means further comprises two cooperating annular seals in axial contact with one another.

* * * * *

UNITED STATES PATENT AND TRADEMARK OFFICE

CERTIFICATE OF CORRECTION

PATENT NO. : 4,339,989

DATED : July 20, 1982

INVENTOR(S) : Webster

It is certified that error appears in the above—identified patent and that said Letters Patent is hereby corrected as shown below:

After the category "[76] Inventor" insert the following:

--[73] Assignee: Edbro Limited,

After "Primary Examiner--Abraham Hershkovitz" insert the following:

--Attorney, Agent, or Firm--Birch, Stewart, Kolasch and Birch--

Signed and Sealed this

*Eighth* Day of *February 1983*

[SEAL]

*Attest:*

GERALD J. MOSSINGHOFF

*Attesting Officer*

*Commissioner of Patents and Trademarks*